US011807965B2

(12) United States Patent
Tsuchiya et al.

(10) Patent No.: US 11,807,965 B2
(45) Date of Patent: Nov. 7, 2023

(54) COORDINATE DATA CREATING DEVICE, SEWING MACHINE AND PROGRAM

(71) Applicant: JANOME Corporation, Hachioji (JP)

(72) Inventors: Minami Tsuchiya, Hachioji (JP); Hiromi Oda, Hachioji (JP)

(73) Assignee: JANOME Corporation, Hachioji (JP)

( * ) Notice: Subject to any disclaimer, the term of this patent is extended or adjusted under 35 U.S.C. 154(b) by 0 days.

(21) Appl. No.: 17/824,900

(22) Filed: May 26, 2022

(65) Prior Publication Data

US 2022/0403574 A1 Dec. 22, 2022

(30) Foreign Application Priority Data

Jun. 17, 2021 (JP) ..... 2021-101038

(51) Int. Cl.
*D05B 19/08* (2006.01)
*D05B 19/10* (2006.01)

(52) U.S. Cl.
CPC ..... *D05B 19/08* (2013.01); *D05B 19/10* (2013.01); *D05B 19/085* (2013.01); *D05B 19/105* (2013.01)

(58) Field of Classification Search
CPC ..... D05B 19/003; D05B 19/02; D05B 19/04; D05B 19/08; D05B 19/10; D05B 19/105; D05B 19/12; D05B 19/14; D05B 19/085
See application file for complete search history.

(56) References Cited

U.S. PATENT DOCUMENTS 5,009,176 A 4/1991 Shigeta et al.
5,692,448 A 12/1997 Shigeta
6,161,491 A * 12/2000 Takenoya ..... D05B 79/00 112/456
6,176,189 B1 * 1/2001 Tomita ..... D05B 19/08 112/102.5
6,209,467 B1 * 4/2001 Tomita ..... D05B 19/08 112/102.5
6,567,721 B1 5/2003 Endo
6,587,745 B1 * 7/2003 Polden ..... D05B 19/08 700/138
10,876,238 B2 * 12/2020 Kongo ..... D05C 7/00
10,995,437 B2 * 5/2021 Kongo ..... D05B 19/08
11,649,575 B2 * 5/2023 Kongo ..... D05B 19/08 112/154
2020/0010990 A1 1/2020 Kongo
(Continued)

FOREIGN PATENT DOCUMENTS

JP 2020-5797 A 1/2020

*Primary Examiner* — Danny Worrell

(74) *Attorney, Agent, or Firm* — Yokoi & Co., U.S.A.; Toshiyuki Yokoi

(57) ABSTRACT

A data storage unit configured to store a sewing order and a coordinate data of a needle location in association with each other; a coordinate data adding unit configured to create the coordinate data of a new needle location on a line connecting three or more continuous needle locations in a sewing order stored in the data storage unit in accordance with a distance from the needle locations located at both ends of the line to the needle location located at an inside of the both ends when the three or more continuous needle locations are on the line; and an added coordinate data creating unit configured to create a new coordinate data by adding independent original values to the X-coordinate value or the Y-coordinate value in each of the coordinate data are provided.

4 Claims, 9 Drawing Sheets

(56) References Cited

U.S. PATENT DOCUMENTS

| | | | | |
|---|---|---|---|---|
| 2021/0285139 | A1* | 9/2021 | Kongo | D05B 19/08 |
| 2022/0403572 | A1* | 12/2022 | Tsuchiya | G05B 19/042 |
| 2022/0403573 | A1* | 12/2022 | Tsuchiya | D05B 19/085 |
| 2022/0403574 | A1* | 12/2022 | Tsuchiya | D05B 19/08 |

* cited by examiner

COORDINATE DATA CREATING DEVICE, SEWING MACHINE AND PROGRAM

CROSS-REFERENCES TO RELATED APPLICATIONS

This patent specification is based on Japanese patent application, No. 2021-101038 filed on Jun. 17, 2021 in the Japan Patent Office, the entire contents of which are incorporated by reference herein.

BACKGROUND OF THE INVENTION

1. Field of the Invention

The present invention is related to a coordinate data creating device, a sewing machine and a program.

2. Description of the Related Art

In general, the positions of seams of a sewing machine are determined by an amplitude position of a needle and a feeding amount of a fabric.

Thus, a pattern is formed by connecting needle location points with each other by threads.

Here, the data is inputted by determining the positions of the needle to be lowered one by one for each stitch based on the drawing to be sewn.

Namely, the sewing data is basically created for faithfully reproducing the original drawing on the seams in many cases.

Thus, the original drawing can be drawn by the seams by connecting the needle location points in straight lines in accordance with the sewing data.

Therefore, the pattern can be faithfully reproduced by anyone by using the sewing machine, and good-looking pattern can be formed on the fabric as if the pattern is sewn by an expert.

However, on the contrary, the above described fact gives mechanical and cool impression.

Considering the above described problem, Patent Document 1 discloses the technology of creating a hand-drawn taste in the sewing pattern by adding an appropriate fluctuation for each stitch to form the seam imparting comfort and warmth.

Furthermore, in the technology described in Patent Document 1, it is possible to deform the pattern into a hand-drawn taste while keeping an original shape by adding the same fluctuation to the coordinate data having the same coordinate even when the sewing order of the needle location is different.

[Patent Document 1] Japanese Unexamined Patent Application Publication No. 2020-5797

BRIEF SUMMARY OF THE INVENTION

In the technology described in Patent Document 1, a fluctuation is added to the original needle location points.

However, when the pattern having a simple shape is processed, for example, an intermediate point of the needle location points is linearly expressed since the intermediate point is sewn by threads.

In particular, if the fluctuation is added at a portion where the distance between the needle location points is long, the linear expression becomes remarkable.

On the other hand, when the distance between arbitrary two points is relatively large, such a portion is still linearly and natural fluctuation cannot be expressed in some cases even when the needle location points are added.

The present invention provides a coordinate data creating device, a sewing machine and a program capable of creating a hand-drawn taste in the sewing pattern by adding an appropriate fluctuation for each stitch to form the seam imparting comfort and warmth and creating the pattern expressing natural fluctuation without losing the original style of the pattern.

Embodiment 1: One or more embodiments of the present invention propose a coordinate data creating device of a sewing machine for creating coordinate data composed of an X-coordinate value and a Y-coordinate value of a needle location of a pattern to be sewn, the coordinate data creating device including: a data storage unit configured to store a sewing order and the coordinate data of the needle location in association with each other; a coordinate data adding unit configured to create the coordinate data of a new needle location on a line connecting three or more continuous needle locations in a sewing order stored in the data storage unit in accordance with a distance from the needle locations located at both ends of the line to the needle location located at an inside of the both ends when the three or more continuous needle locations are on the line; and an added coordinate data creating unit configured to create a new coordinate data by adding independent original values to the X-coordinate value or the Y-coordinate value in each of the coordinate data.

Embodiment 2: One or more embodiments of the present invention propose the coordinate data creating device wherein the coordinate data adding unit is configured to create the coordinate data so that distances between the needle locations located on the line are equal to each other.

Embodiment 3: One or more embodiments of the present invention propose a sewing machine having the coordinate data creating device according to the embodiments 1 or 2.

Embodiment 4: One or more embodiments of the present invention propose a program for making a computer execute a coordinate data creating method of a coordinate data creating device of a sewing machine for creating coordinate data composed of an X-coordinate value and a Y-coordinate value of a needle location of a pattern to be sewn, the coordinate data creating device including: a data storage unit configured to store a sewing order and the coordinate data of the needle location in association with each other; a coordinate data adding unit; and an added coordinate data creating unit, the method including: a first process processed by the coordinate data adding unit for creating the coordinate data of a new needle location on a line connecting three or more continuous needle locations in a sewing order stored in the data storage unit in accordance with a distance from the needle locations located at both ends of the line to the needle location located at an inside of the both ends when the three or more continuous needle locations are on the line; and a second process processed by the added coordinate data creating unit for creating a new coordinate data by adding independent original values to the X-coordinate value or the Y-coordinate value in each of the coordinate data.

One or more embodiments of the present invention have an effect that a hand-drawn taste can be created in the sewing pattern by adding an appropriate fluctuation for each stitch to form the seam imparting comfort and warmth and the pattern expressing natural fluctuation can be created without losing the original style of the pattern.

DETAILED DESCRIPTION OF THE INVENTION

Embodiments

Hereafter, the embodiments of the present invention will be explained using FIG. 1 to FIG. 8.

<Electrical Configuration of Coordinate Data Creating Device 10>

An electrical configuration of a coordinate data creating device 10 concerning the present embodiment will be explained using FIG. 1.

Figure 1:
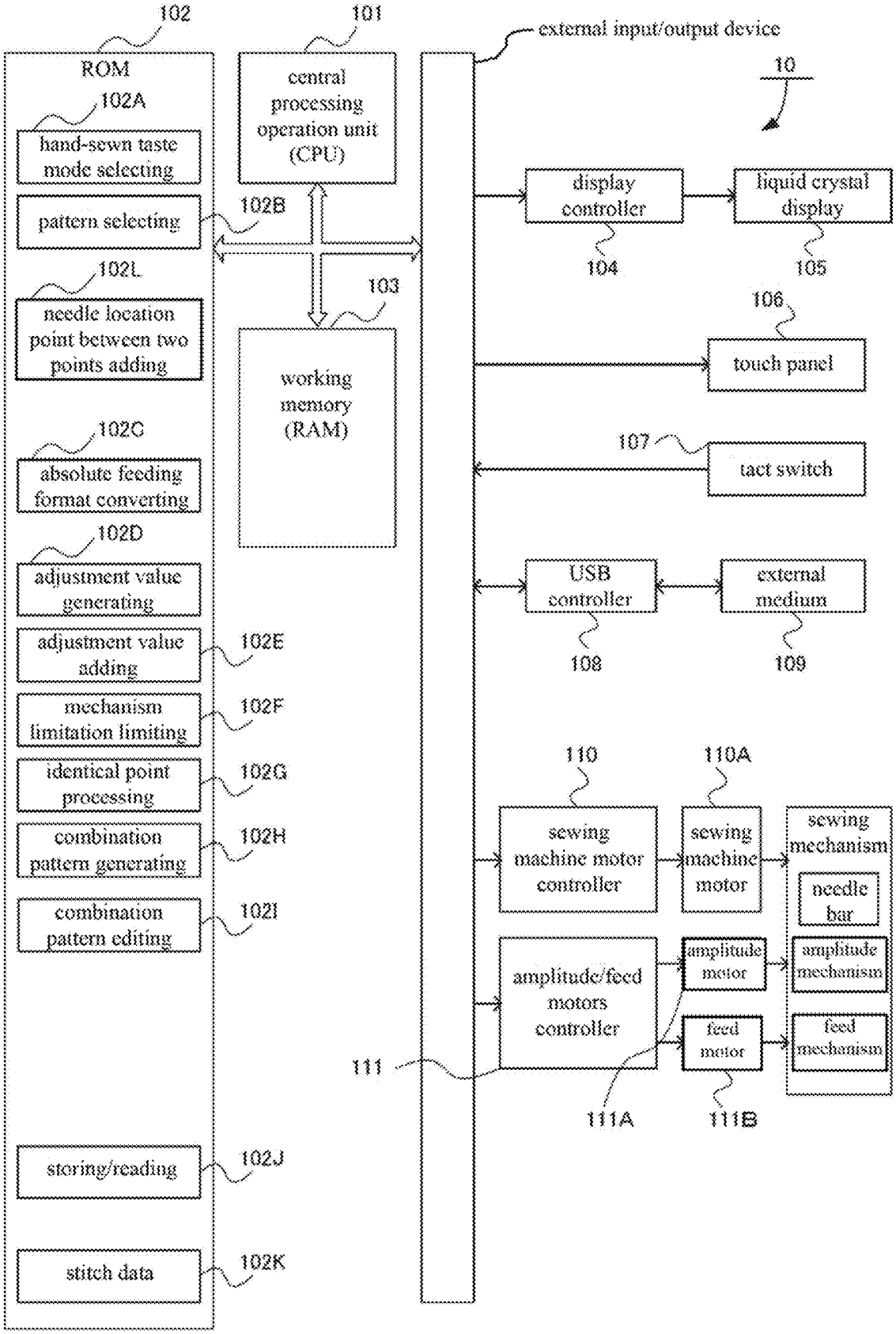
FIG. 1 is a block diagram showing an electrical configuration of a coordinate data creating device concerning an embodiment of the present invention.

As shown in FIG. 1, the coordinate data creating device 10 concerning the present embodiment is configured to include a central processing operation unit (CPU) 101, a ROM 102, a working memory (RAM) 103, a display controller 104, a liquid crystal display 105, a touch panel 106, a tact switch 107, a USB controller 108, an external medium 109, a sewing machine motor controller 110, an amplitude/feed motors controller 111, a sewing machine motor 110A, an amplitude motor 111A and a feed motor 111B.

The central processing operation unit (CPU) 101 controls the operations of the entire coordinate data creating device 10 in accordance with control programs stored in the ROM 102.

In addition, the central processing unit (CPU) 101 is connected with various devices via an external input/output device.

The ROM 102 is mainly functions as a storage unit for storing stitch data and functional modules in the present embodiment.

The RAM 103 mainly functions as a working memory for temporarily storing working data and the like in the present embodiment.

The ROM 102 stores various functional modules and data such as a hand-sewn taste mode selecting module 102A, a pattern selecting module 102B, an absolute feeding format converting module 102C, an adjustment value generating module 102D, an adjustment value adding module 102E, a mechanism limitation limiting module 102F, an identical point processing module 102G, a combination pattern generating module 102H, a combination pattern editing module 102I, a storing/reading module 102J, a stitch data 102K storing area and a needle location point between two points adding module 102L.

Figure 3:
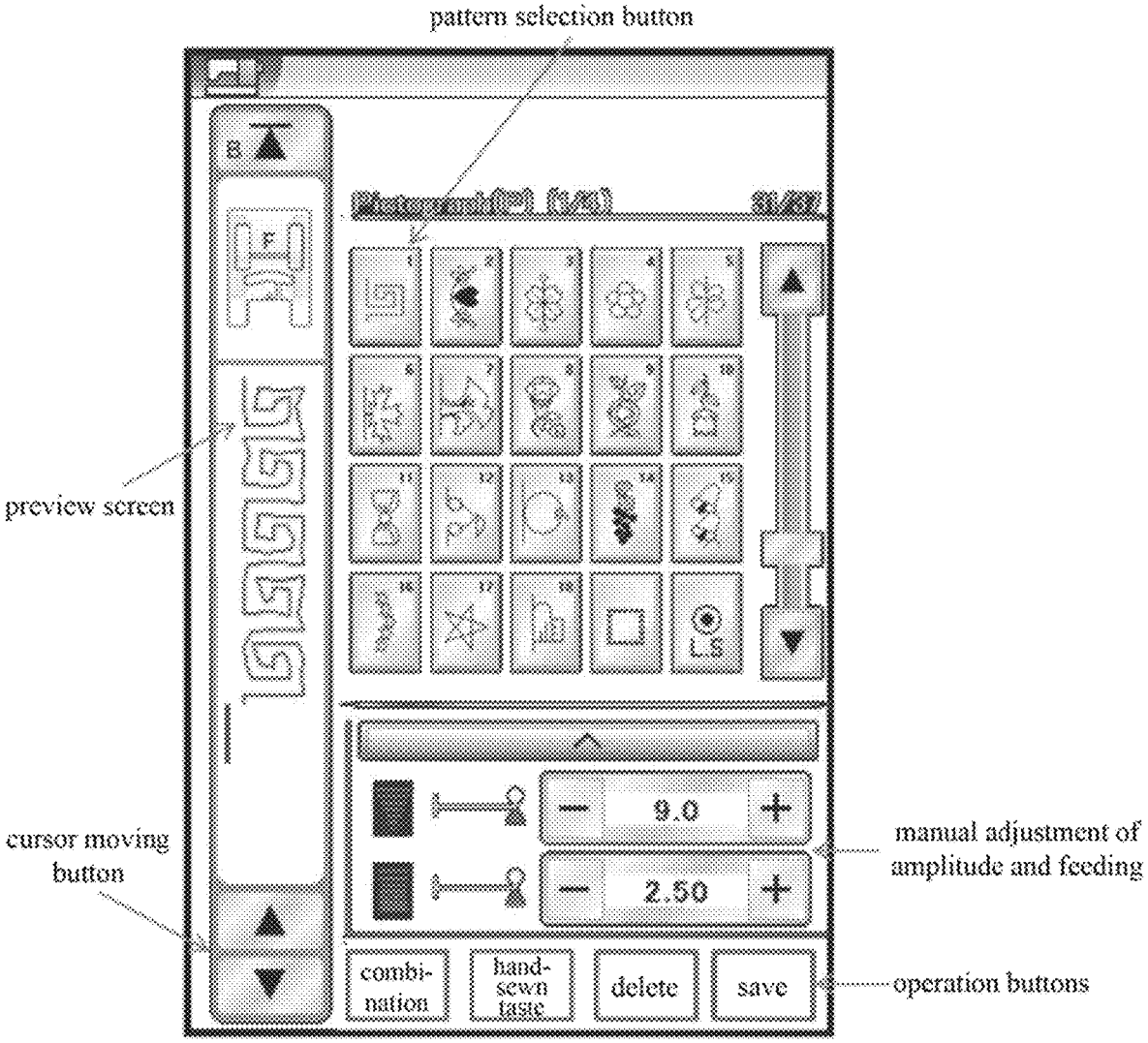
FIG. 3 is a drawing illustrating the operation screen operated in the coordinate data creating device concerning an embodiment of the present invention.

The hand-sewn taste mode selecting module 102A is a module enabled when a user presses "hand-sewn taste" button of the operation screen displayed on the liquid crystal display 105 shown in FIG. 3. Thus, a stitch data 102K is finely adjusted by a hand-drawn taste stitch conversion function for the patterns selected after that.

The pattern selecting module 102B is a module for reading one stitch of the stitch data 102K when the user presses No. 1 button in "pattern selection" buttons of the operation screen in the liquid crystal display 105 shown in FIG. 3, for example. Thus, the stich of the stitch number 1 incorporated in the ROM 102 of the sewing machine is selected.

The absolute feeding format converting module 102C is a module for accumulating a relative amount of the stitch data 102K, which is a relative feeding amount, and converting it into the data of an absolute coordinate.

The adjustment value generating module 102D is a module for converting the random value of the integer into the unit of length with 0.1 millimeter unit and generating the adjustment value when the user operates the pattern selection operation by the pattern selecting module 102B.

Note that the adjustment value corresponding to the coordinate data of a newly created needle location position (needle location point) created in the later described needle location point between two points adding module 102L is also generated.

The adjustment value adding module 102E is a module for adding the adjustment value generated by the adjustment value generating module 102D to the original amplitude value and absolute feeding data.

Note that the corresponding adjustment value generated in the adjustment value generating module 102D is also added to the coordinate data of a newly generated needle location generated in the later described needle location point between two points adding module 102L.

The mechanism limitation limiting module 102F is a module enabled when the processing result processed by the adjustment value adding module 102E exceeds the limit value of the amplitude/feeding mechanism. Thus, the execution of the processing processed by the adjustment value adding module 102E is limited.

The identical point processing module 102G is a module activated when another original data exists within the same or approximate range of one original data in the original data which is the absolute coordinate data to which the adjustment value is not added. Thus, identical point processing module 102G executes the processing of identifying (matching) the coordinates after the adjustment with each other between the same or approximate coordinates in the already adjusted coordinate.

The combination pattern generating module 102H is a module for temporarily storing the data of one pattern in the working memory (RAM) 103 in a state that the hand-sewn taste processing is added to the data.

The combination pattern generating module 102H is a module for displaying one pattern converted into the hand-sewn taste on "preview screen" of the operation screen displayed on the liquid crystal display 105 shown in FIG. 3 via the display controller 104.

In addition, the combination pattern generating module 102H is a module for creating a combination pattern by finely adjusting the stitch data 102K by new random number when the user selects the same pattern again.

The combination pattern editing module 102I is a module for deleting or adding the patterns and changing the combination of the patterns.

Furthermore, the combination pattern editing module 102I is a module for finely adjusting the pattern by new random number when the pattern is added.

The storing/reading module 102J is a module for writing the combined pattern data in the external medium 109 and the like.

In addition, the storing/reading module 102J is a module for reading the combined pattern data from the external medium 109 and the like.

The needle location point between two points adding module 102L creates the coordinate data of one or a plurality of new needle locations on a line connecting three or more continuous needle locations in a sewing order stored in the stitch data 102K storing area of the ROM 102 (i.e., data storage unit) in accordance with a distance from the needle locations located at both ends of the line to the needle location located at an inside (between two points) of the both ends when the three or more continuous needle locations are on the line so that the new needle location located inside is separated at an appropriate distance from the both ends on the line.

At the same time, the needle locations located inside the both ends before adding the new needle locations are moved on the line.

The coordinate data created in accordance with the new needle locations and the needle locations moved on the line is stored in the stitch data 102K storing area of the ROM 102 (i.e., data storage unit).

In the above described explanation, one or a plurality of new needle locations is added so that the needle locations are separated from each other at an appropriate distance and the needle locations located inside the both ends before adding the new needle locations are moved. However, it is also possible that the needle locations located inside the both ends before adding the new needle locations are deleted and then a plurality of needle locations is added so that the needle locations are separated from each other at an appropriate distance.

Note that the needle location point between two points adding module 102L can create the coordinate data so that the distances between the needle locations forming the line are equal to each other after the coordinate data of the new needle locations is created.

Various functional modules (e.g., OS, basic library) read from the ROM 102 are temporarily stored in the RAM 103.

In addition, the data used for the operation in the central processing operation unit (CPU) 101 is also temporarily stored and saved in the RAM 103.

The display controller 104 is a device for executing the control of the display data displayed on the later described liquid crystal display 105.

The liquid crystal display 105 is a device for displaying the operation screen shown in FIG. 3, for example.

The liquid crystal display 105 is electrically connected with the central processing operation unit (CPU) 101 via the external input/output device.

In addition, the liquid crystal display 105 has a multilayer structure where the later described touch panel 106 is layered below a display surface. Thus, the touch panel 106 and the liquid crystal display 105 are unitized as "display unit."

Thus, patterns, characters, buttons and the like are displayed on the liquid crystal display 105.

The touch panel 106 is configured as a panel of a capacitance type, a resistive film type or the like. The touch panel 106 is electrically connected with the central processing operation unit (CPU) 101 via the external input/output device.

In addition, considering user's convenience, the touch panel 106 is arranged to be exposed to the outside of the coordinate data creating device 10 so as to be operable.

Therefore, the user can operate the touch panel 106 by touching the touch panel with fingers while checking the selection of a hand-sewn taste mode and the selection of the pattern on the screen.

When the user presses the tact switch 107, the instructions of starting/stopping sewing, the vertical movement of the needle, the threading (not illustrated) and the like are transferred to the central processing unit 101.

The USB (Universal Serial Bus) controller 108 connects the coordinate data creating device 10 with the external devices such as the external medium 109 and executes the control.

The external medium 109 is a hard disk, a DVD recorder or the like, for example. The external medium 109 writes and stores the pattern data or the like under the control of the USB controller 108.

The sewing machine motor controller 110 controls to drive the sewing machine motor 110A according to the command transmitted from the central processing operation unit (CPU) 101. Thus, the sewing machine motor controller 110 controls the processing of vertically moving a needle bar to form seams by a sewing needle, an upper thread and a lower thread.

The amplitude/feed motors controller 111 controls to drive the amplitude motor 111A and the feed motor 111B. Thus, the amplitude/feed motors controller 111 controls the operation of the needle bar, the feeding amount of the fabric fed by a feed dog and switching of the forward/backward operation in the sewing mechanism.

The amplitude/feed motors controller 111 controls the needle location and the feeding amount of the fabric to form the seams while changing the position of the seams. Thus, the pattern is formed.

The central processing operation unit (CPU) 101 sequentially executes the program module stored in the ROM 102 and converts the normal sewing data into the hand-sewn taste stitch data, for example.

For example, the central processing operation unit (CPU) 101 moves (displaces) the needle location points of the normal sewing stitch data in the X-direction and Y-direction by a minute distance. Thus, hand-sewn taste is created on the sewing pattern by finely adjusting all needle location points by different lengths and directions.

More specifically, the central processing operation unit (CPU) 101 generates the coordinate string of the needle location points of the sewing image from the stitch data 102K.

The central processing operation unit (CPU) 101 generates a random number, generates the adjustment value of a minute length (+1.0 mm), and add the minute length to the coordinate of the X-direction and the Y-direction of each of the needle location points.

Furthermore, when same or approximate coordinate exists in the needle location points of the original data, the central processing operation unit (CPU) 101 can execute the processing of identifying the coordinates after the adjustment with each other between the same or approximate coordinates in the already adjusted coordinate via the identical point processing module 102G. Thus, the combination pattern can be created by the stitch data 102K converted into the hand-sewn taste.

Here, the approximate range is a preliminarily determined range. For example, the approximate range can be ±0.2 mm or less, for example.

It is also possible that the range of the approximate is arbitrarily changed by the user.

Note that the details of the processing will be described later.

<Processing of Coordinate Data Creating Device>

Figure 2:
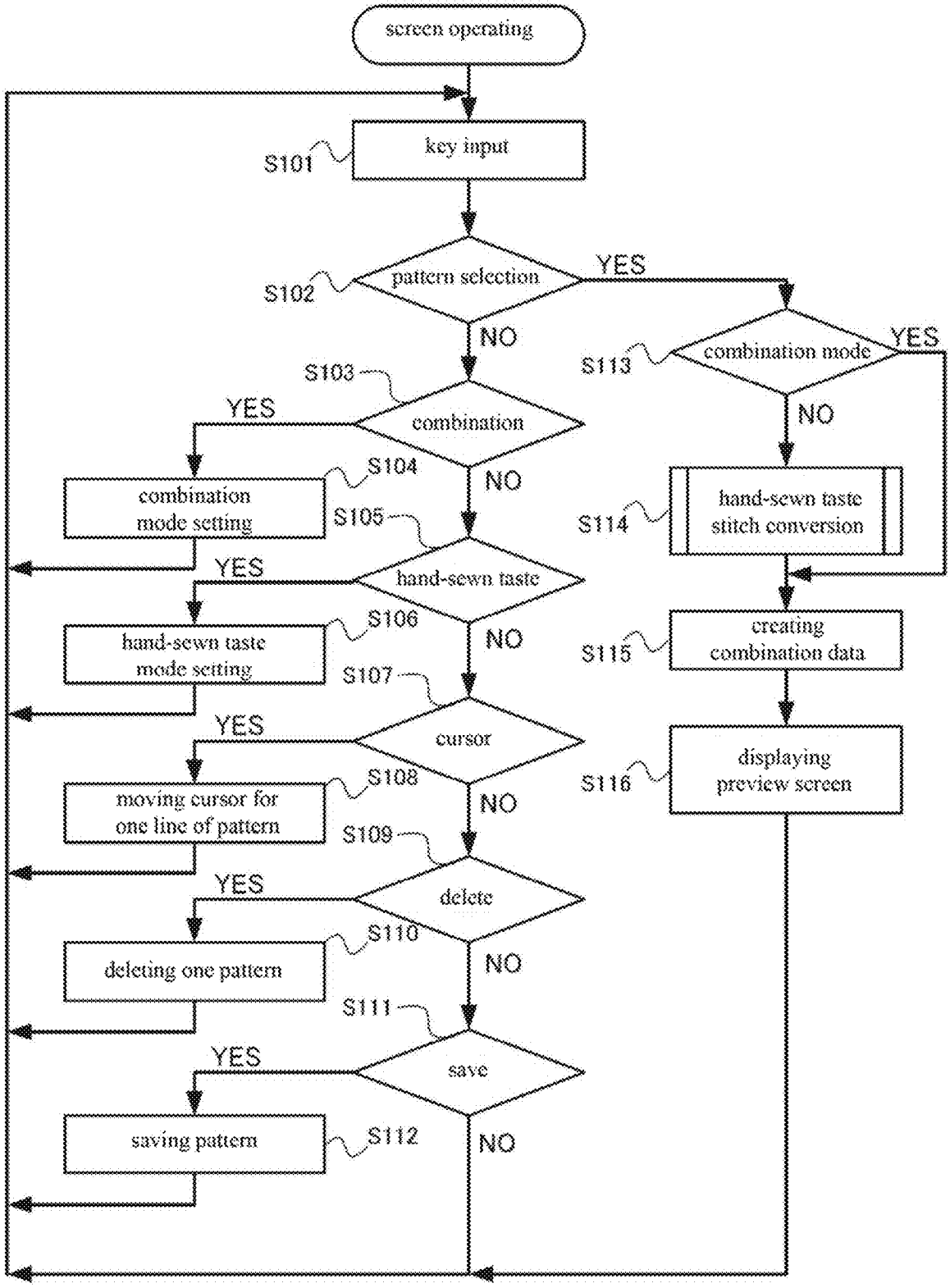
FIG. 2 is a processing flowchart for operating an operation screen of the coordinate data creating device concerning an embodiment of the present invention.
Figure 4:
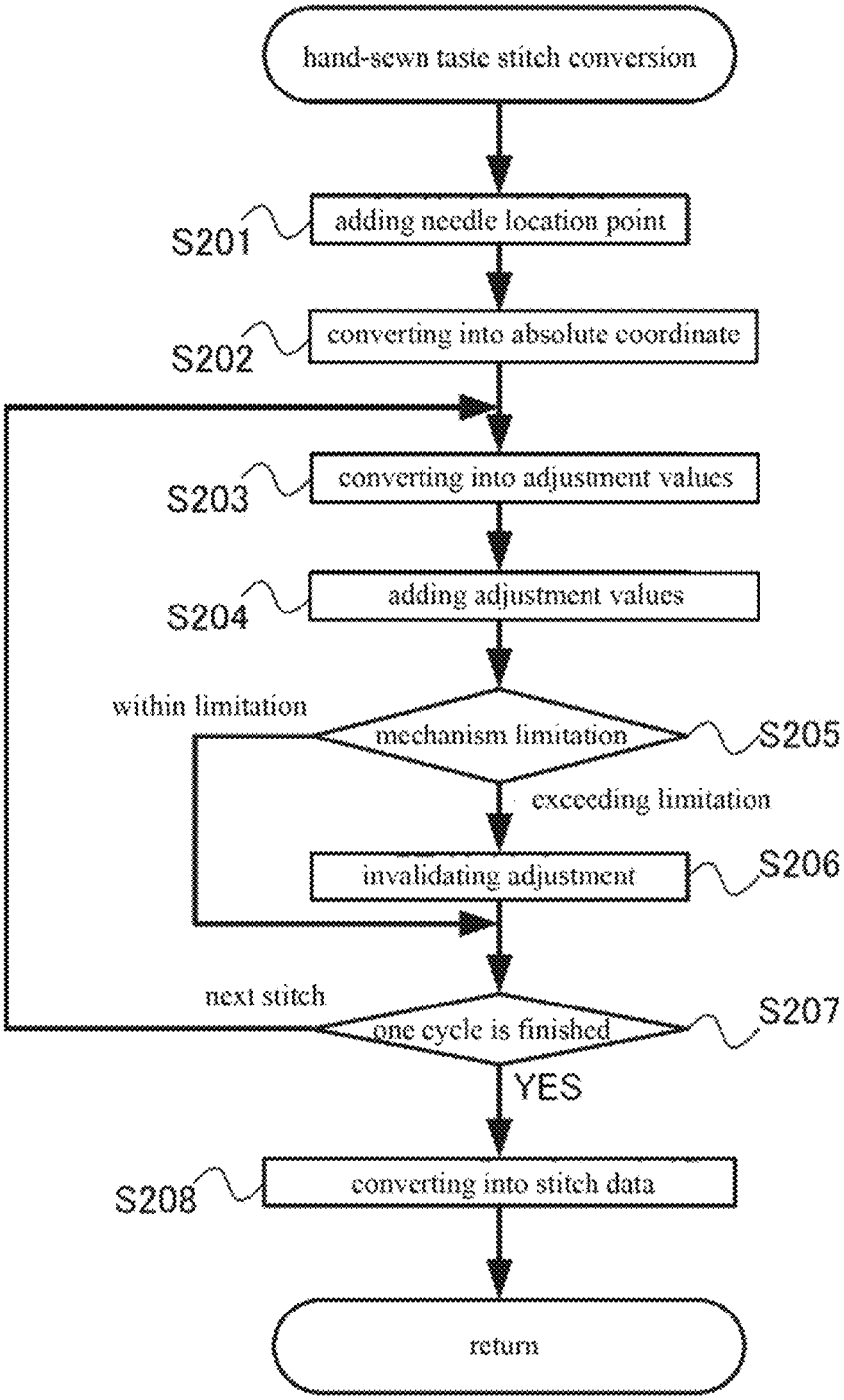
FIG. 4 is a processing flowchart related to a hand-sewn taste stitch conversion in the coordinate data creating device concerning an embodiment of the present invention.

The details of the screen operating processing and the hand-sewn taste stitch conversion processing in the coordinate data creating device 10 of the present embodiment will be explained by using FIG. 2 to FIG. 4.

<Screen Operating Processing>

The creation of the sewing data using the coordinate data creating device 10 of the present embodiment is performed by operating the screen displayed on the liquid crystal display 105 shown in FIG. 3.

Accordingly, before explaining the detailed processing of the coordinate data creating device 10, the details of the screen operating processing in the coordinate data creating device 10 of the present embodiment will be explained using FIG. 2.

When the display mode for displaying the operation screen shown in FIG. 3 on the liquid crystal display 105 is selected by the user, the central processing unit (CPU) 101 of the coordinate data creating device 10 first shifts the mode to the waiting mode for waiting the pressing of operation buttons, cursor moving buttons, pattern selection buttons and the like by a key input of the user (Step S101).

Then, the central processing unit (CPU) 101 determines whether or not the pattern is selected by the user (Step S102).

As a result of the determination, when the central processing unit (CPU) 101 determines that the pattern is selected by the user (i.e., the pattern number is inputted by the user, for example) ("Yes" in Step S102), the central processing unit (CPU) 101 determines whether the processing is the combination mode or the hand-sewn taste mode (Step S113).

In both of the processing of the combination mode and the processing of the hand-sewn taste mode, the processing is performed and the pattern is stored in the selected order.

In Step S102, as a result of the determination, when the central processing unit (CPU) 101 determines that the pattern is not selected by the user (i.e., the pattern number is not inputted by the user, for example) ("No" in Step S102) and the combination button is pressed ("Yes" in Step S103), the mode is set to the combination mode and the process is returned to Step S101 (Step S104).

On the other hand, when the central processing unit (CPU) 101 determines that the combination button is not pressed by the user in Step S103 ("No" in Step S103), the central processing unit (CPU) 101 determines whether or not the hand-sewn taste button is pressed by the user (Step S105).

When the central processing unit (CPU) 101 determines that the hand-sewn taste button is pressed by the user in Step S105 ("Yes" in Step S105), the mode is set to the hand-sewn taste mode and the process is returned to Step S101 (Step S106).

On the other hand, when the central processing unit (CPU) 101 determines that the hand-sewn taste button is not pressed by the user in Step S105 ("No" in Step S105), the central processing unit (CPU) 101 determines whether or not the cursor moving buttons are pressed by the user (Step S107).

When the central processing unit (CPU) 101 determines that the cursor moving buttons are pressed by the user in Step S107 ("Yes" in Step S107), the cursor is moved forward or backward for a line of the pattern stored in the ROM 102 and the process is returned to Step S101 (Step S108).

On the other hand, when the central processing unit (CPU) 101 determines that the cursor moving buttons are not pressed by the user in Step S107 ("No" in Step S107), the central processing unit (CPU) 101 determines whether or not the delete button is pressed by the user (Step S109).

When the central processing unit (CPU) 101 determines that the delete button is pressed by the user in Step S109 ("Yes" in Step S109), the pattern indicated by the cursor position is deleted, the following patterns are moved forward and the process is returned to Step S101 (Step S110).

On the other hand, when the central processing unit (CPU) 101 determines that the delete button is not pressed by the user in Step S109 ("No" in Step S109), the central processing unit (CPU) 101 determines whether or not the save button is pressed by the user (Step S111).

When the central processing unit (CPU) 101 determines that the save button is pressed by the user in Step S111 ("Yes" in Step S111), the pattern converted into the hand-sewn taste and the combination pattern are stored in the external medium 109 or the like so as to be used again and the process is returned to Step S101 (Step S112).

On the other hand, when the central processing unit (CPU) 101 determines that the save button is not pressed by the user in Step S111 ("No" in Step S111), the process is returned to Step S101.

When the central processing unit (CPU) 101 determines that the pattern selection buttons are pressed in the hand-sewn taste mode by the user in Step S113 ("No" in Step S113), the hand-sewn taste stitch conversion processing is called (Step S114).

Note that the details of the hand-sewn taste stitch conversion processing will be described later.

On the other hand, when the central processing unit (CPU) 101 determines that the combination mode button is pressed by the user in Step S113 ("Yes" in Step S113) and the hand-sewn taste stitch conversion processing in Step S114 is finished, the pattern data is combined similar to the combination of the normal pattern (Step S115).

Then, the central processing unit (CPU) 101 displays the preview screen on the liquid crystal display 105 in Step S116.

Consequently, the user can check the converted state.

Note that the editing operations such as deletion and addition are possible since the patterns converted by the hand-sewn taste mode are equally treated as the normal patterns.

<Hand-Sewn Taste Stitch Conversion Processing>

The details of the hand-sewn taste stitch conversion processing will be explained by using FIG. 4.

When three or more continuous needle location points in the sewing order are located on a line, one or a plurality of new needle location points is additionally created between the two points located at both ends of the line.

At the same time, the needle location points located inside the needle location points of the both ends before adding the new needle location points are moved on the line.

Since both the newly created needle location points and the needle location points moved on the line are fluctuated, the change of the needle location points can be increased.

In addition, since the number of the needles is increased by adding the new needle location points, the fluctuation can be increased.

Accordingly, even when the distance between the two points A, B is long and the points A, B are fluctuated in opposite directions to each other, for example, the distance between the two points A, B can be prevented from being excessively enlarged.

In the above described explanation, one or a plurality of new needle location points is added and the needle location points located inside the both ends before adding the new needle location are moved. However, it is also possible that the needle location points located inside the both ends before adding the new needle location points are deleted and then a plurality of needle location points is added so that the needle location points are separated from each other at an appropriate distance.

When one new needle location point is added to the line formed by three needle location points, the coordinate data can be created so that the plurality of needle location points forming the line is separated from each other at a constant interval and the two points located at the both ends of the line are equally divided into three.

Here, "line" can be a straight line or a curved line which is formed of a plurality of needle location points to function as an element of forming the pattern.

Then, the processing is executed for the stich to which the needle location points are added as described above.

Specifically, the data of the feeding direction, which is a relative moving amount, is once converted into the data string indicated as the absolute coordinate indicating the location of the needle location points.

Then, a random number is generated and the adjustment amount of 1 mm or less is prepared for each of the needle location points for displacing the X-coordinate and the Y-coordinate of the needle location points.

Note that the random value is not necessarily generated as needed. A preliminarily generated adjustment data can be stored as a table format.

The adjustment value generated by the random value in a range of 1 mm (example) is added to the data string of the absolute coordinate indicating the needle location points.

Namely, the needle location points are slightly displaced from the original positions.

As for the adjusted coordinate data, the width in the amplitude direction is limited within the width of the mechanism (e.g., 8.8 mm), and the distance between two sequential needle locations in the feeding direction is limited within the limitation of the distance of the mechanism (e.g., 5 mm).

Then, the data string of the needle location points indicated as the absolute coordinate is converted into the relative moving amount in the feeding direction to convert the format into the stitch data format of the normal sewing.

Hereafter, the details of the hand-sewn taste stitch conversion processing will be explained.

<Details of Processing of Hand-Sewn Taste Stitch Conversion>

In order to perform the processing, as an initial operation, the user presses "hand-sewn taste" button on the operation screen displayed on the liquid crystal display 105 shown in FIG. 3 to select the combination mode of the hand-sewn taste.

Then, the user presses the pattern selection buttons to select the pattern.

First, when the coordinate data of three or more needle locations in a sewing order are located on a line based on the sewing order and the coordinate data of the needle locations stored in the data storage unit (ROM 102), the central processing operation unit (CPU) 101 of the coordinate data creating device 10 creates the coordinate data of one or a plurality of new needle locations so that the needle locations are located at an appropriate distance in accordance with a distance from the needle locations located at both ends of the line to the needle locations located at an inside of the both ends of the line (Step S201).

At the same time, the needle location points located inside the needle location points of the both ends before adding one or a plurality of new needle locations are moved on the line.

It is also possible that the needle location points located inside the both ends before adding the new needle location points are deleted and then a plurality of needle location points is added so that the needle location points are separated from each other at an appropriate distance.

The central processing unit (CPU) 101 of the coordinate data creating device 10 converts the stitch data 102K to which the coordinate data is added in Step S201 into the data string indicated as the absolute coordinate by an accumulation processing of the relative feeding amount (Step S202). Note that the feeding direction is indicated as the relative moving amount in the stitch data 102K.

The central processing operation unit (CPU) 101 acquires two random numbers respectively for the amplitude and the feeding.

Since the acquired random numbers are integrals, they are converted into the adjustment values within the range of 1.0 mm (Step S203).

The central processing unit (CPU) 101 adds the adjustment values converted in Step S203 to the coordinates of the amplitude direction and the feeding direction for finely adjusting the coordinates (Step S204).

However, since the coordinates cannot be finely adjusted exceeding the limit value of the mechanism, the central processing unit (CPU) 101 determines whether or not the distance between the X-coordinate value of the finely adjusted coordinate data of a certain needle location point and the X-coordinate value of the neighboring finely adjusted coordinate data in the sewing order is within the limitation of the feeding mechanism (Step S205).

As for the amplitude, the central processing unit (CPU) 101 determines whether or not the Y-coordinate value of the finely adjusted coordinate data is within the limitation of the amplitude mechanism (Step S205).

Here, when the finely adjusted coordinate data exceeds the limitation of the mechanism in the feeding (X-coordinate) direction or in the amplitude (Y-coordinate) direction, the finely adjusted processing of Step S204 is invalidated (Step S206).

Here, the value of the limitation of the mechanism in the amplitude direction can be −4.4 mm or +4.4 mm, for example, and the value of the limitation of the mechanism in the feeding direction can be −5.0 mm or +5.0 mm as the relative moving amount, for example.

Although the above described explanation is related to the limitation in the normal sewing, the finely adjusted processing of Step S204 is invalidated even in the embroidery sewing when the value of the finely adjusted coordinate data exceeds the limitation of the mechanism in the X-coordinate direction or in the Y-coordinate direction (Step S206).

Although not illustrated, it is also possible to generate the adjustment value again and the finely adjusted processing is performed within the range of the limitation of the mechanism.

On the other hand, when the finely adjusted coordinates in the amplitude direction and in the feeding direction do not exceed the limitation of the mechanism, the process is shifted to Step S207.

The central processing unit (CPU) 101 determines whether or not one cycle of the stitch is finished (Step S207).

When the central processing unit (CPU) 101 determines that the stitch still remains and one stitch is not finished, the process is returned to Step S203.

In this case, the central processing unit (CPU) 101 generates a new random value for the next needle location point and Step S203 and the following procedures are performed.

On the other hand, when the central processing unit (CPU) 101 determines that one cycle is finished ("Yes" in Step S207), the feeding data indicated as the absolute coordinate is converted into the relative moving amount to return to the original format of the stitch data (Step S208).

Then, all processes are finished.

First Example

Hereafter, the first example of the present invention will be explained using FIG. 5 to FIG. 8.

In the present embodiment, the processing of automatically generating a needle location point between two points located at both ends of the line when three or more continuous needle location points are located on the line will be explained.

Figure 5:
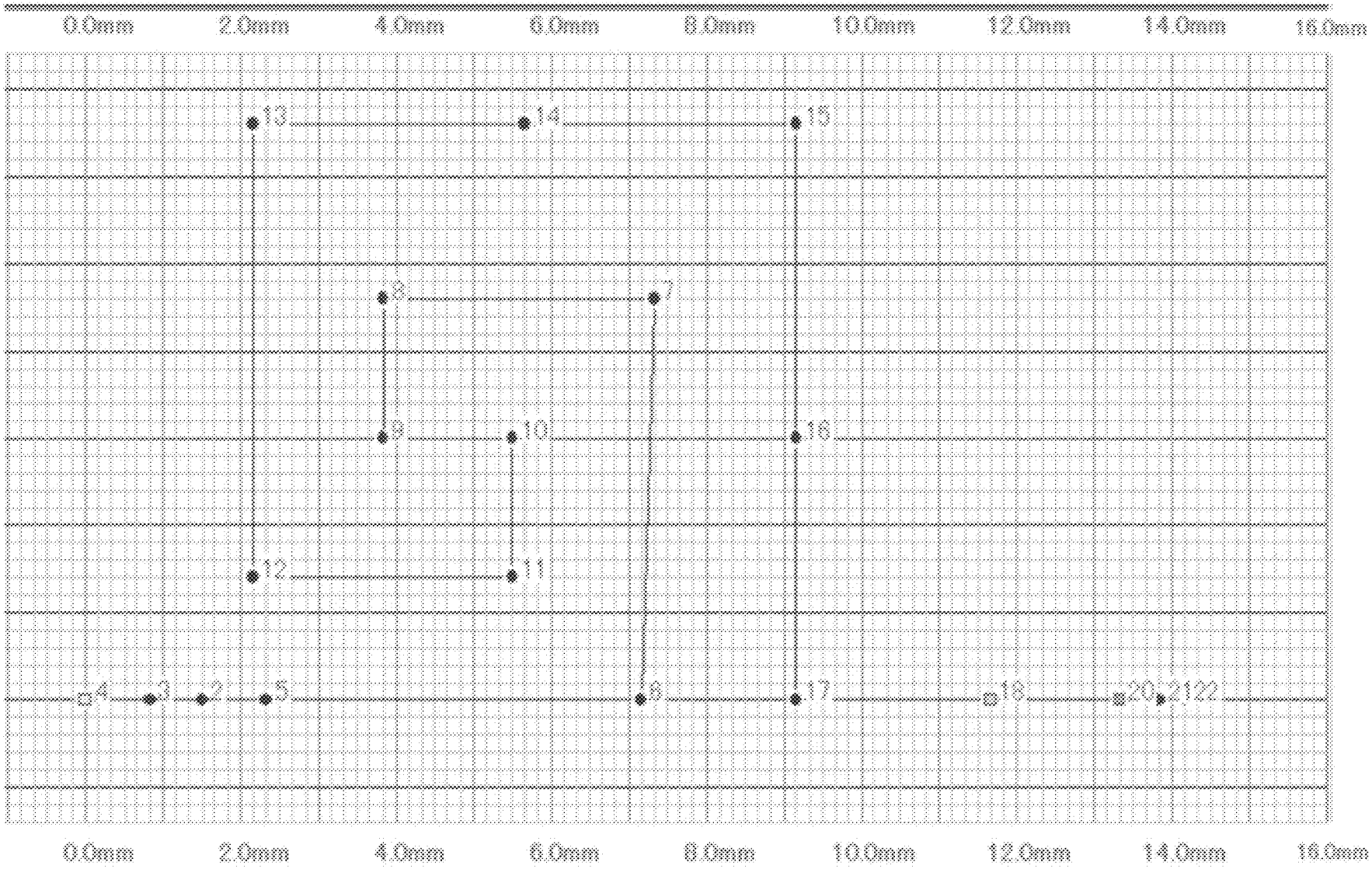
FIG. 5 is a drawing illustrating a pattern of the original data when the needle location point is automatically generated on the line between the needle locations of both ends concerning the first example of the present invention.

As shown in FIG. 5, a distance (interval) between the needle location points may be set to long in some patterns.

When the conventional hand-sewn taste stitch conversion is performed in the above described patterns, the amplitude may be changed than the user imaged. In that case, the sewing may be performed by the design which is significantly different from the image of the original pattern.

Therefore, when the coordinate data of three or more continuous needle locations in the sewing order stored in the stitch data 102K storing area of the ROM 102 (i.e., data storage unit) are on the line, the coordinate data of new needle locations is created so that the new needle locations are located on the line inside the needle locations of both ends of the line in accordance with the distance from the needle locations of the both ends of the line to the needle location located inside the needle locations of the both ends.

For example, when the coordinate data of three or more continuous needle locations in the sewing order are on the line as shown in the 13th, 14th and 15th needle locations of FIG. 5, the coordinate date of new needle locations (20th or 21th needle location in FIG. 6) are created on the line inside the needle locations of both ends (19th and 22th needle locations in FIG. 6) in accordance with the distance from the needle locations of both ends of the line (13th and 15th needle locations) to the needle location located inside the both ends (14th needle location).

Figure 6:
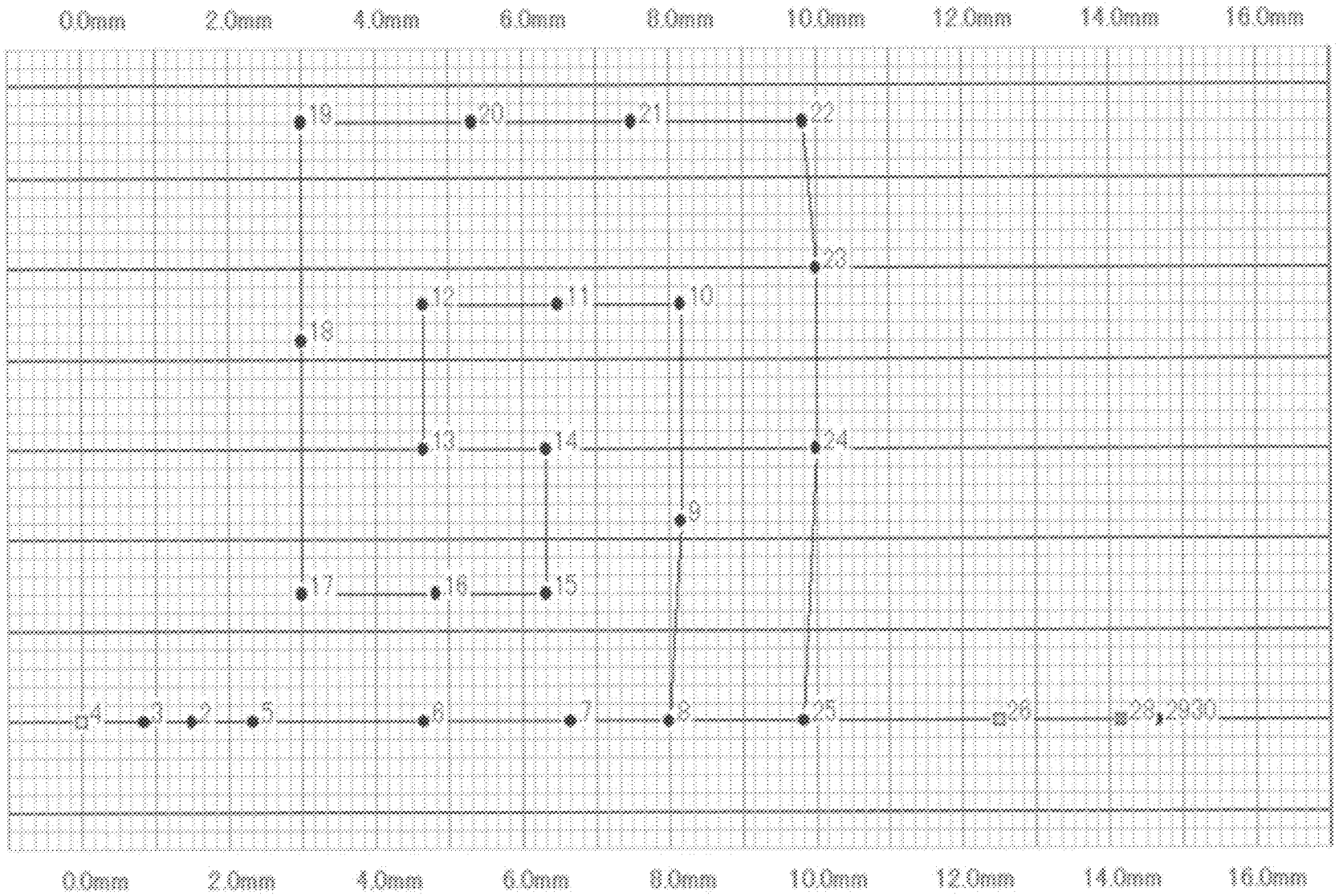
FIG. 6 is a drawing illustrating a pattern after the needle location point is added when the needle location point is automatically generated on the line between the needle locations of both ends concerning the first example of the present invention.

The above described addition of the new needle location is different from the operation of merely adding a new needle location between two sequential needle locations in accordance with the distance between two sequential needle locations (e.g., the operation of adding the 23th needle location shown in FIG. 6 between the 15th needle location and 16th needle location shown in FIG. 5).

In the present invention, the line (e.g., straight line as one line of a certain pattern) forming the pattern by a plurality of needle location points is regarded as one unit and the contents (components) of the line (e.g., needle location points forming the inside of the both ends of one line of the pattern) are changed (needle location points are added) without changing the entire shape (e.g., both ends of the one line of the pattern).

The above described change of the contents includes not only the addition of new needle location points on the line but also the displacement of the needle location points which have been already existed inside the needle location points of the both ends of the line when adding the new needle location points.

The entire line as an element of the pattern is not changed while the content of the element of the pattern is changed by adding one or a plurality of new needle location points and/or displacing the positions of the already existed needle location points inside the needle location points of both ends of the line.

In the above described explanation, one or a plurality of new needle location points is added and the needle location points located inside the both ends before adding the new needle location are displaced. However, it is also possible that the needle location points located inside the both ends before adding the new needle location points are deleted and then a plurality of needle location points is added so that the needle location points are separated from each other at an appropriate distance.

The coordinate data created corresponding to new needle locations is stored in the stitch data 102K storing area of the ROM 102 (i.e., data storage unit).

Note that the needle location point between two points adding module 102L can create the coordinate data so that the needle locations forming the line are separated from each other at a constant interval.

Here, the number of "new needle locations" to be added can be increased and reduced in accordance with the distance between the needle location points or the setting set by the user.

The fluctuation itself is fluctuated within the preliminarily determined range by the automatically generated random number.

For example, the random number is ±1.0 mm in the present embodiment.

For example, even when the fluctuation is made smaller (e.g., ±0.5 mm in the amplitude), the pattern can be shown as being fluctuated since new needle location points are added and the number of the needles is increased.

Figure 7A:
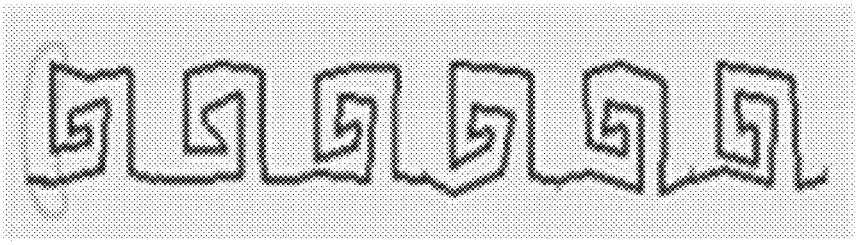
FIGS. 7A and 7B are drawings for illustratively comparing sewing images between the case where the needle location point of the first example of the present invention is added and the case where the needle location point is not added.
Figure 7B:
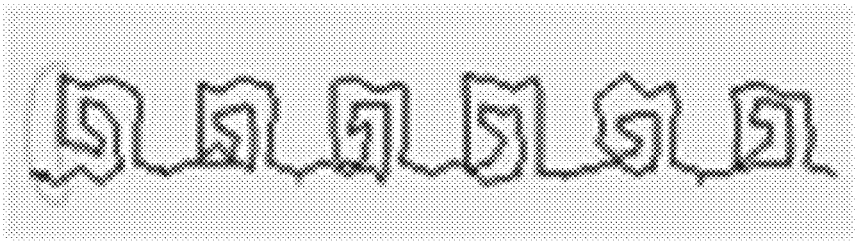

FIG. 7A shows an image of the entire pattern where new needle location points are not added. FIG. 7B shows an image of the entire pattern where new needle location points are added.

Figure 8:
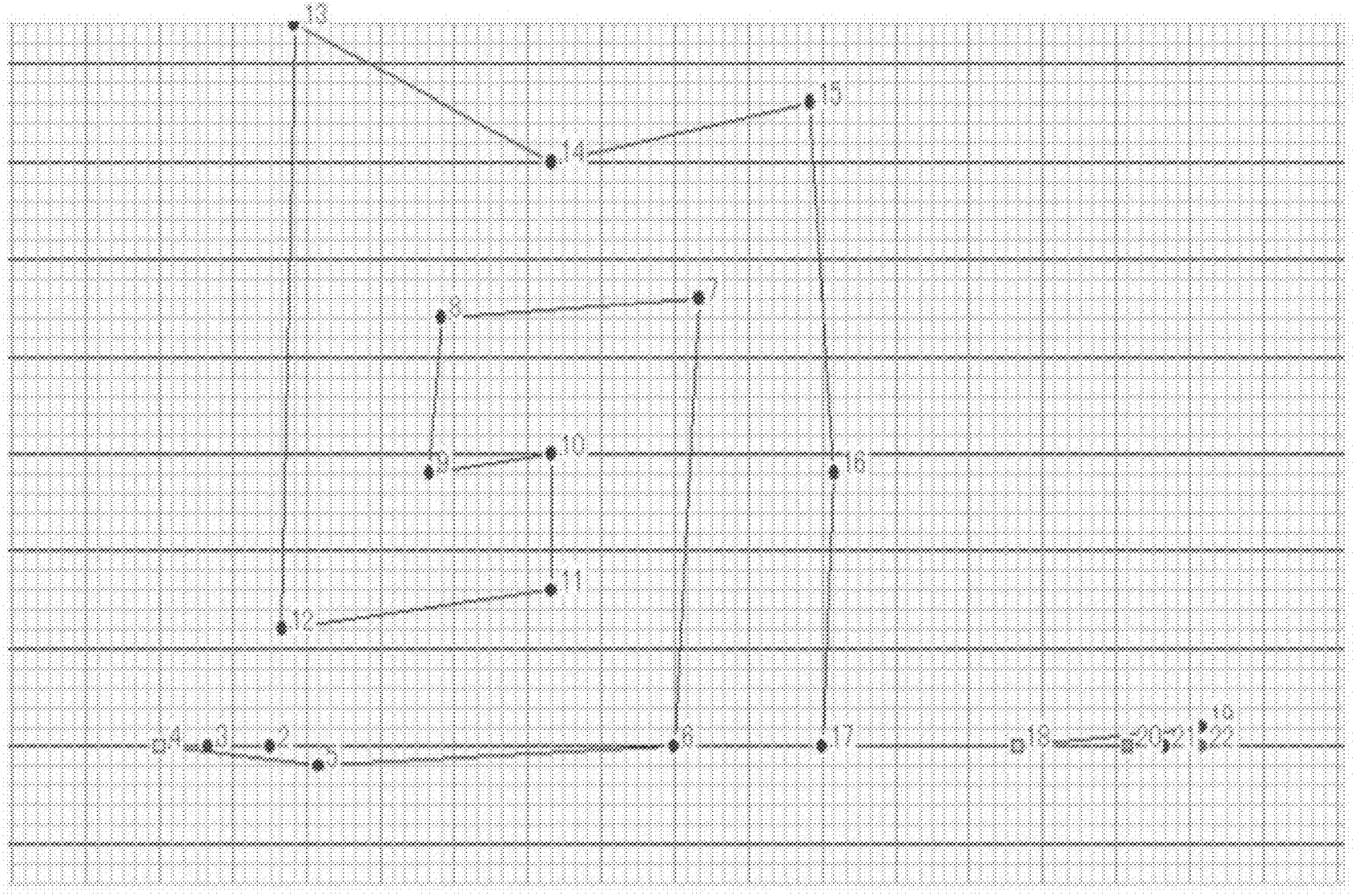
FIG. 8 is a drawing for illustratively comparing sewing images in the case where the needle location point is not added concerning the first example of the present invention.
Figure 9:
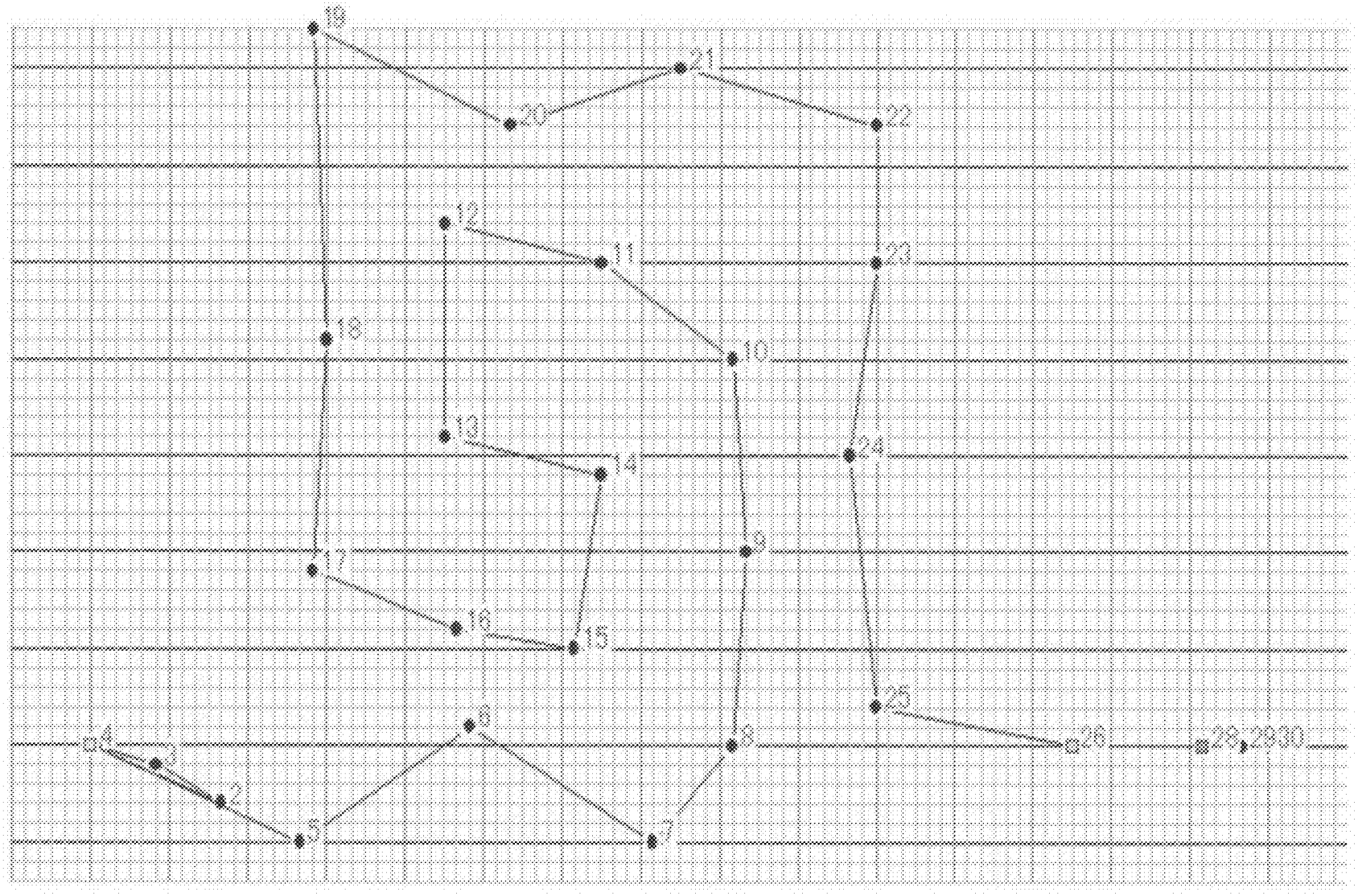
FIG. 9 is a drawing for illustratively comparing sewing images in the case where the needle location point is added concerning the first example of the present invention.

FIG. 8 shows an image where the random number is added only to the already existed needle location points without adding new needle location points to the original pattern. FIG. 9 shows an image where new needle location points are added to the original pattern and the random number is added to the already existed needle location points and the newly added needle location points.

<Operation and Effect>

As explained above, in the present embodiments and the present examples, the coordinate data creating device 10 is a coordinate data creating device of a sewing machine for creating coordinate data composed of an X-coordinate value and a Y-coordinate value of a needle location of a pattern to be sewn, the coordinate data creating device including: a data storage unit (ROM 102) configured to store a sewing order and the coordinate data of the needle location in association with each other; a coordinate data adding unit (needle location point between two points adding module 102L) configured to create the coordinate data of a new needle location on a line connecting three or more continuous needle locations in a sewing order stored in the data storage unit (ROM 102) in accordance with a distance from the needle locations located at both ends of the line to the needle location located at an inside of the both ends when the three or more continuous needle locations are on the line; and an added coordinate data creating unit (adjustment value adding module 102E) configured to create a new coordinate data by adding independent original values to the X-coordinate value or the Y-coordinate value in each of the coordinate data stored in the data storage unit (ROM 102).

Here, "independent original values to be added" mean a random number adjustment length or a random number adjustment value generated for the amplitude and the feeding of each stich.

Namely, when the coordinate data of three or more continuous needle locations in a sewing order are located on the line based on the sewing order and the coordinate data of the needle locations stored in the data storage unit (ROM 102), the coordinate data of new needle locations is created so that the new needle locations are located on the line inside the needle locations of both ends of the line in accordance with the distance from the needle locations of the both ends of the line to the needle location located inside the needle locations of the both ends.

The above described addition of the new needle location is different from the operation of merely adding a new needle location between two sequential needle locations in accordance with the distance between two sequential needle locations (e.g., the operation of adding the 23th needle location shown in FIG. 6 between the 15th needle location and 16th needle location shown in FIG. 5).

In the present invention, the line (e.g., straight line as one line of a certain pattern) forming the pattern by a plurality of needle location points is regarded as one unit and the contents (components) of the line (e.g., needle location points forming the inside of the both ends of one line of the pattern) are changed (needle location points are added) without changing the entire shape (e.g., both ends of the one line of the pattern).

The above described change of the contents includes not only the addition of new needle location points on the line but also the displacement of the needle location points which have been already existed inside the needle location points of the both ends of the line when adding the new needle location points.

The entire line as an element of the pattern is not changed while the content of the element of the pattern is changed by adding one or a plurality of new needle location points and/or displacing the positions of the already existed needle location points inside the needle location points of both ends of the line.

Then, a new coordinate data is created by adding independent original values respectively to an X-coordinate value or a Y-coordinate value for each of the coordinate data stored in the data storage unit (ROM 102).

Accordingly, a hand-drawn taste is created in the sewing pattern while keeping the taste of the original pattern by adding an appropriate fluctuation to each stitch at a short interval and the seam imparting comfort and warmth can be formed and the pattern expressing natural fluctuation can be created without losing the original style of the pattern.

In particular, the contents of the line (i.e., element of pattern) are changed and the needle location points are fluctuated by adding new needle location points and displacing the positions of the needle location points already existed before adding the new needle location points. Thus, the linearly expressed pattern can be changed into the pattern expressing natural fluctuation only by adding a small number of needle location points.

As an example, three points (e.g., 13th to 15th needle location points) located on the line shown in FIG. 5 are separated from each other (interval between the points is long). Even when a new needle location point is merely added between the two points (e.g., between 13th and 14th needle location points), the other two points (e.g., 14th and 15th needle location points) are still separated from each other.

Therefore, in the present invention, new needle location points are added on the line formed by the 13th to 15th needle location points and the needle location point (14th needle location point in FIG. 5) which has been already existed inside the both ends (13th and 15th needle location points in FIG. 5) before adding the new needle location point is displaced on the line. Thus, the contents of the line can be changed as shown in the 19th to 22th needle location points in FIG. 6.

By the above described operation, the linear pattern shown in FIG. 8 can be converted into the pattern shown in FIG. 9 which expresses natural fluctuation only by adding a fewer (one) needle location point.

Note that the coordinate data includes both the coordinate data of the normal sewing and the coordinate data of the embroidery sewing.

In addition, the processing of adding independent values which are independent from each other to the X-coordinate value or the Y-coordinate value of the coordinate data is the processing of adding the independent values to the value of the X-coordinate and the value of the Y-coordinate respectively. Thus, when considering the case where one of the independent values is zero, the processing can include the case where the independent value is added only to one of X-coordinate or the Y-coordinate of the coordinate data, for example.

In addition, the coordinate data creating device 10 creates the coordinate data so that the needle locations forming the line are separated from each other at a constant interval.

More specifically, the coordinate data is created so that the positions of the needle location points forming the line are separated from each other at a constant interval by adding one or a plurality of new needle location points on the line so that the new needle location points are separated from each other at an appropriate distance and displacing the needle location points existed inside both ends of the line before adding the new needle location points on the line.

Accordingly, a hand-drawn taste is created in the sewing pattern while keeping the taste of the original pattern by adding an appropriate fluctuation to each stitch at a short interval and the seam imparting comfort and warmth can be formed and the pattern expressing natural fluctuation can be created without losing the original style of the pattern.

Note that the coordinate data creating device 10 of the present invention can be achieved by recording the processing of the coordinate data creating device 10 on a computer system or a computer readable recording medium and reading and executing the program recorded in the recording medium by the coordinate data creating device 10.

Here, the computer system or the computer includes an OS (operating system) and hardware such as a peripheral device.

When the WWW (World Wide Web) system is used, "the computer system or the computer" includes a providing environment (or display environment) of the webpage.

The program can be transferred from the computer system or the computer which stores the program in the storage unit or the like to other computer systems or computers via a transmission media or via transmission waves in the transmission media.

Here, "the transmission media" for transmitting the program is the media having a function of transmitting information. For example, "the transmission media" is a network (communication network) such as Internet and a communication line (communication wire) such as telephone wire.

It is also possible to achieve only a part of the above described functions by the program.

It is also possible to achieve the above described functions by combining the above described program with the programs already stored in the computer system or the computer. Namely, the program can be so-called a difference file (difference program).

Although the embodiments of the present invention are explained above with reference to drawings, the specific configuration is not limited to the above described embodiments. The specification can be changed within a range being not deviated from the subject-matter of the present invention.

For example, the coordinate data creating device 10 can be a separately provided device such as a personal computer and a device included in the sewing machine or the like.

Note that, this invention is not limited to the above-mentioned embodiments.

Although it is to those skilled in the art, the following are disclosed as the one embodiment of this invention.

Mutually substitutable members, configurations, etc. disclosed in the embodiment can be used with their combination altered appropriately.

Although not disclosed in the embodiment, members, configurations, etc. that belong to the known technology and can be substituted with the members, the configurations, etc. disclosed in the embodiment can be appropriately substituted or are used by altering their combination.

Although not disclosed in the embodiment, members, configurations, etc. that those skilled in the art can consider as substitutions of the members, the configurations, etc. disclosed in the embodiment are substituted with the above mentioned appropriately or are used by altering its combination.

While the invention has been particularly shown and described with respect to preferred embodiments thereof, it should be understood by those skilled in the art that the foregoing and other changes in form and detail may be made therein without departing from the sprit and scope of the invention as defined in the appended claims.

What is claimed is:

1. A coordinate data creating device of a sewing machine for creating coordinate data composed of an X-coordinate value and a Y-coordinate value of a needle location of a pattern to be sewn, the coordinate data creating device comprising:

a data storage unit configured to store a sewing order and the coordinate data of the needle location in association with each other;

a coordinate data adding unit configured to create the coordinate data of a new needle location on a line connecting three or more continuous needle locations in a sewing order stored in the data storage unit in accordance with a distance from the needle locations located at both ends of the line to the needle location located at an inside of the both ends when the three or more continuous needle locations are on the line; and an added coordinate data creating unit configured to create a new coordinate data by adding independent original values to the X-coordinate value or the Y-coordinate value in each of the coordinate data.

2. The coordinate data creating device according to claim 1, wherein the coordinate data adding unit is configured to create the coordinate data so that distances between the needle locations located on the line are equal to each other.

3. A sewing machine having the coordinate data creating device according to claim 1.

4. A non-transitory computer readable medium having stored thereon a program for executing a coordinate data creating method of a coordinate data creating device of a sewing machine for creating coordinate data composed of an X-coordinate value and a Y-coordinate value of a needle location of a pattern to be sewn, the coordinate data creating device comprising:

a data storage unit configured to store a sewing order and the coordinate data of the needle location in association with each other;

a coordinate data adding unit; and an added coordinate data creating unit, the method comprising:

a first process processed by the coordinate data adding unit for creating the coordinate data of a new needle location on a line connecting three or more continuous needle locations in a sewing order stored in the data storage unit in accordance with a distance from the needle locations located at both ends of the line to the needle location located at an inside of the both ends when the three or more continuous needle locations are on the line; and a second process processed by the added coordinate data creating unit for creating a new coordinate data by adding independent original values to the X-coordinate value or the Y-coordinate value in each of the coordinate data.

* * * * *